US012454870B1

(12) United States Patent
Schultz et al.

(10) Patent No.: US 12,454,870 B1
(45) Date of Patent: Oct. 28, 2025

(54) ADVANCEMENT OF A BOTTOM HOLE ASSEMBLY INTO A WELLBORE AND WORKSTRING CONNECTION

(71) Applicant: THRU TUBING SOLUTIONS, INC., Newcastle, OK (US)

(72) Inventors: Roger L. Schultz, Ninnekah, OK (US); Andrew M. Ferguson, Moore, OK (US); Dustin Locklear, Moore, OK (US); Bradley J. Miller, Joliet, MT (US); Taylor M. Vollmer, Surrey, SD (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 19/018,390

(22) Filed: Jan. 13, 2025

Related U.S. Application Data

(60) Provisional application No. 63/725,221, filed on Nov. 26, 2024, provisional application No. 63/724,528, filed on Nov. 25, 2024, provisional application No. 63/679,457, filed on Aug. 5, 2024.

(51) Int. Cl.
*E21B 31/00* (2006.01)
*E21B 33/12* (2006.01)
*E21B 34/06* (2006.01)

(52) U.S. Cl.
CPC ..... *E21B 31/005* (2013.01); *E21B 33/12* (2013.01); *E21B 34/06* (2013.01)

(58) Field of Classification Search
CPC ..... E21B 31/005; E21B 33/12; E21B 34/06
See application file for complete search history.

(56) References Cited

U.S. PATENT DOCUMENTS 4,847,815 A * 7/1989 Malone ..... E21B 47/18 367/84
4,890,682 A * 1/1990 Worrall ..... E21B 31/113 175/298
6,571,870 B2 * 6/2003 Zheng ..... E21B 4/18 166/177.6
6,907,927 B2 * 6/2005 Zheng ..... E21B 31/005 166/177.6

(Continued)

OTHER PUBLICATIONS

Thru Tubing Solutions; "Dimple Coiled Tubing Connector", product catalog via www.thrutubing.com, dated 2021, 1 page.

(Continued)

*Primary Examiner* — Steven A MacDonald
(74) *Attorney, Agent, or Firm* — Smith IP Services, P.C.

(57) ABSTRACT

A system for use with a subterranean well can include a bottom hole assembly connected at a distal end of a tubing section, and another bottom hole assembly connected between the tubing section and another tubing section that comprises continuous coiled tubing. A method of performing a well operation can include deploying a tubular string into a wellbore, the tubular string comprising multiple tubing sections, a bottom hole assembly connected at a distal end of one of the tubing sections, and another bottom hole assembly connected between two tubing sections. An uphole tubing section comprises continuous coiled tubing. The tubular string is retrieved from the wellbore. The deploying and the retrieving are performed in a single trip of the tubular string into the wellbore.

23 Claims, 11 Drawing Sheets

(56) References Cited

U.S. PATENT DOCUMENTS 7,219,726 B2 * 5/2007 Zheng ..... E21B 4/18 166/177.6
7,264,055 B2 * 9/2007 Mody ..... E21B 31/005 166/177.2
2001/0052427 A1 * 12/2001 Eppink ..... E21B 7/068 175/263
2002/0121378 A1 * 9/2002 Zheng ..... E21B 28/00 166/177.6
2002/0148606 A1 * 10/2002 Zheng ..... E21B 31/005 166/177.6
2004/0055744 A1 * 3/2004 Zheng ..... E21B 28/00 166/177.6
2005/0006146 A1 * 1/2005 Mody ..... E21B 31/005 166/301
2005/0230101 A1 * 10/2005 Zheng ..... E21B 4/18 166/177.6
2005/0257931 A1 * 11/2005 Mody ..... E21B 31/005 166/301
2012/0292116 A1 * 11/2012 Schultz ..... E21B 28/00 137/809
2014/0116724 A1 * 5/2014 McDougall ..... E21B 34/142 166/380
2016/0230503 A1 * 8/2016 Holmberg ..... E21B 34/10
2019/0153797 A1 * 5/2019 von Gynz-Rekowski ..... E21B 31/005
2025/0101810 A1 * 3/2025 Rowcliffe ..... E21B 29/06

OTHER PUBLICATIONS

Thru Tubing Solutions; "Anti-Rotation Roll-On Connector", product catalog via www.thrutubing.com, dated 2021, 1 page.
Thru Tubing Solutions; "Slim Line Coiled Tubing Connector", product catalog via www.thrutubing.com, dated 2021, 1 page.
Thru Tubing Solutions; "External Slip Type CT Connector", product catalog via www.thrutubing.com, dated 2021, 1 page.
Thru Tubing Solutions; "Snubbing Back Pressure Valve", product catalog via www.thrutubing.com, dated 2021, 1 page.

* cited by examiner

ADVANCEMENT OF A BOTTOM HOLE ASSEMBLY INTO A WELLBORE AND WORKSTRING CONNECTION

CROSS-REFERENCE TO RELATED APPLICATIONS

This application claims the benefit of the filing dates of U.S. provisional application No. 63/679,457 filed on 5 Aug. 2024, U.S. provisional application No. 63/724,528 filed on 25 Nov. 2024, and U.S. provisional application No. 63/725,221 filed on 26 Nov. 2024. The entire disclosures of these prior applications are hereby incorporated herein in their entireties for all purposes.

BACKGROUND

This disclosure relates generally to equipment utilized and operations performed in conjunction with a subterranean well and, in one example described below, more particularly provides for advancement of a bottom hole assembly through a wellbore and workstring connections therefor.

A vibratory tool is used downhole in a well, typically in order to reduce friction between a tubular string and a wellbore, or to otherwise aid advancement of the tubular string through the wellbore. Vibrations, impacts or pressure pulses generated by a vibratory tool can reduce or eliminate differential sticking and/or static friction between a tubular string and a wall of a wellbore.

It will, therefore, be readily appreciated that improvements are continually needed in the art of designing, constructing and utilizing systems and methods for advancement of tubular strings through wellbores. The present disclosure provides such improvements and others, which improvements may be utilized in a wide variety of different well configurations and operations.

DETAILED DESCRIPTION

Figure 1:
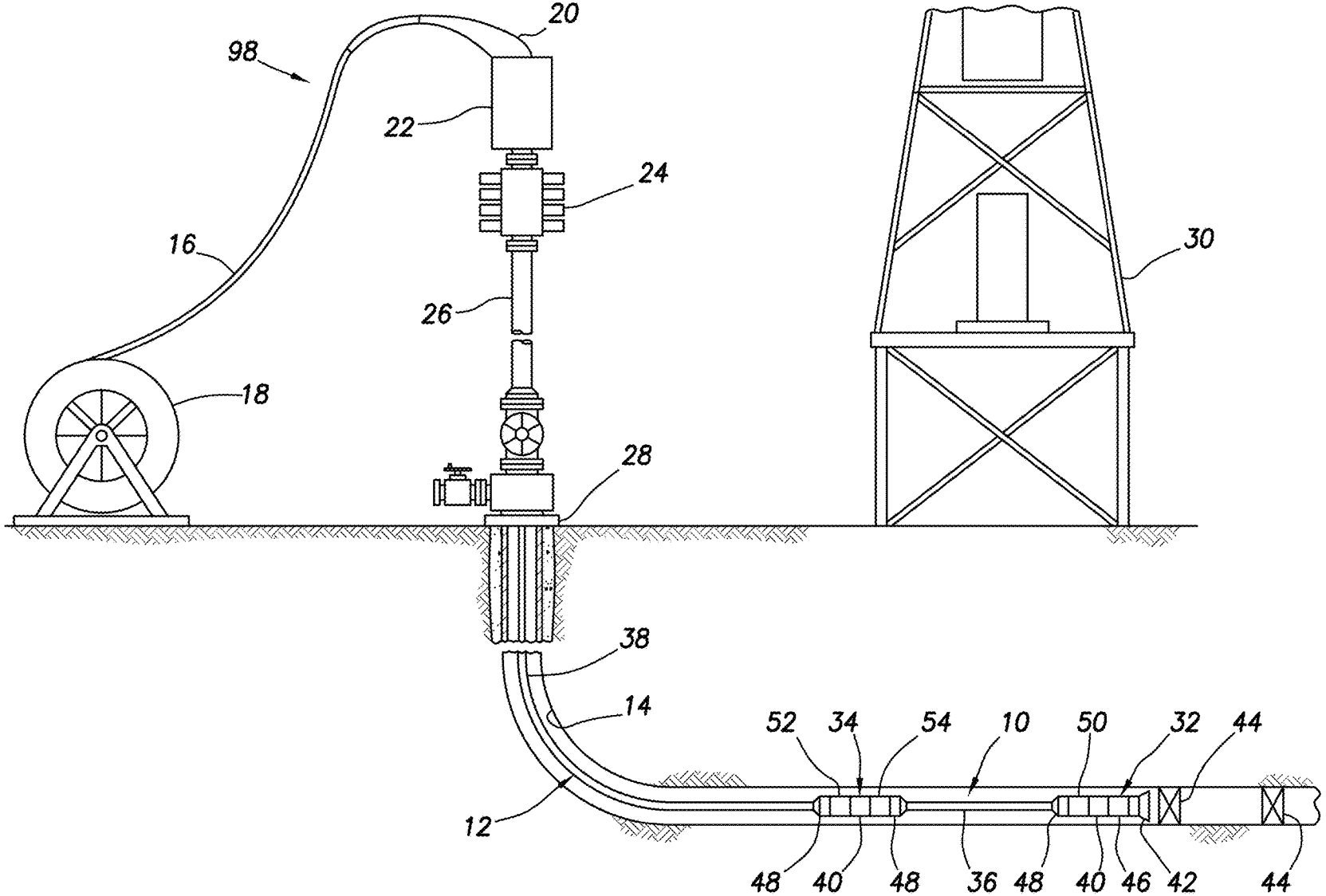
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is deployed into a wellbore 14. In this example, the tubular string 12 is made up of continuous, or substantially continuous, tubing 16 of the type known to those skilled in the art as coiled tubing, which is coiled or spooled on a reel 18 at surface before and after deployment into a well. In some examples, the tubular string 12 may also comprise one or more sections of jointed tubing, for example, including separate threaded together tubing joints.

As depicted in FIG. 1, the tubing 16 is installed into and retrieved from the well using certain equipment, such as, a "gooseneck" tubing guide 20, an injector 22, a blowout preventer stack 24, a lubricator 26, etc., connected above a wellhead 28. However, other equipment and other combinations of equipment may be used in other examples. Where jointed tubing is used as part of the tubular string 12, appropriate jointed tubing handling equipment (such as, a rotary or top drive rig 30) may be substituted for the coiled tubing equipment when running or retrieving the jointed tubing.

The tubular string 12 in the FIG. 1 example comprises multiple bottom hole assemblies 32, 34. The bottom hole assemblies 32, 34 are spaced apart by means of a tubing section 36. The bottom hole assemblies 32, 34 and the tubing section 36 are conveyed through the wellbore 14 by another tubing section 38.

In other examples, more than two bottom hole assemblies may be used. In situations in which more than two bottom hole assemblies are used, a tubing section 36 may be used to separate each adjacent pair of the bottom hole assemblies. As used herein, the term "bottom hole assembly" is used to indicate a downhole tool assembly. A bottom hole assembly is not necessarily positioned at a "bottom" or distal end of a wellbore.

In the FIG. 1 example, the tubular string 12 is deployed into a generally horizontal section of the wellbore 14. It will be appreciated that friction between the tubular string 12 and the wellbore 14 increases with deviation of the wellbore from vertical. Thus, it is desired to reduce the friction between the tubular string 12 and the wellbore 14, so that the tubular string can be extended a substantial distance into the horizontal section of the wellbore.

Each of the bottom hole assemblies 32, 34 includes a vibratory tool 40 used to produce vibrations (such as, impacts, pressure pulses, accelerations, etc., in various examples). The vibratory tools 40 may be the same or different, and any number of vibratory tools may be used. The vibratory tools 40 may produce the vibrations due to fluid flow through the vibratory tools. The vibratory tools 40 may be activated by various means (such as, manipulation of the tubular string 12, deployment of a ball or other plug into the tubular string, electromagnetic or acoustic telemetry, etc.). The scope of this disclosure is not limited to use of any particular type of vibratory tool, to any particular means for activating a vibratory tool, or to use of a vibratory tool at all.

As depicted in FIG. 1, the lower bottom hole assembly 32 includes a mill, drill or other cutting tool 42. As used herein, the term "lower" is used to refer to an element or component that is further downhole from, or toward a distal end of, the tubular string 12, as compared to another element or component that is further uphole along the tubular string.

In the FIG. 1 example, the cutting tool 42 is used to mill or cut through frac plugs 44 previously set in the wellbore 14. The bottom hole assembly 32 also includes a fluid motor 46 (such as, a Moineau-type or turbine fluid motor) that rotates the cutting tool 42 in response to fluid flow through the tubular string 12.

The bottom hole assembly 32 may further include various types of logging, telemetry, steering, ranging and/or other tools 50. The scope of this disclosure is not limited to use of any particular types, number or combination of tools included in the bottom hole assembly 32.

The bottom hole assembly 32 is connected to the tubing section 36 by means of a tubing connector 48. A similar tubing connector 48 is used to connect the bottom hole assembly 34 to the tubing section 36. If the tubing section 36 is made up of jointed pipe or segmented tubing, the jointed pipe or tubing may be threaded to the tubing connectors 48. If the tubing section 36 is made up of continuous tubing (such as, coiled tubing), the tubing connectors 48 may be of the type depicted in FIG. 4 and described more fully below.

The bottom hole assembly 34 is sometimes referred to herein as a "mid-string" bottom hole assembly (BHA), since it is connected between sections 36, 38 of the tubular string 12. In the FIG. 1 example, the bottom hole assembly 34 includes the vibratory tool 40, and may also include various other tools 52 (such as, logging, telemetry, ranging, etc., tools). The scope of this disclosure is not limited to use of any particular types, number or combination of tools included in the bottom hole assembly 34.

In some examples, the bottom hole assembly 34 may also include a valve 54. The valve 54 may be useful to isolate the tubular string 12 below the valve, such as, when retrieving the tubular string 12 to the surface and there is elevated pressure in the tubular string.

For example, the valve 54 can be closed when it reaches the surface (or before), pressure in the tubular string 12 above the valve can then be bled off, the tubular string above the valve can be disconnected, and the lubricator 26 and/or other safety equipment can be used to safely retrieve the valve and the remainder of the tubular string below the valve from the well. If the tubing section 36 is made up of jointed pipe or tubing, the rig 30 may be moved onto the well after the tubular string 12 above the valve 54 has been disconnected and the coiled tubing rig has been moved off of the well.

It is desirable to be able to circulate fluid through the tubular string 12 while it is being deployed into the wellbore 14. However, it may not be desirable for the vibratory tools 40 to produce substantial vibrations during most of the deployment of the tubular string 12 (such as, while the bottom hole assemblies 32, 34 are in a generally vertical section of the wellbore 14). In some examples, it may be desired to begin producing vibrations from the vibratory tools 32, 34 only after the tubular string 12 is extended a substantial distance into a horizontal section of the wellbore 14.

If the vibratory tools 40 are of the type that produce vibrations in response to fluid flow through the vibratory tools after deployment of plugs into the vibratory tools, the deployment of the plugs can be delayed until the tubular string 12 is extended a desired distance into the horizontal section of the wellbore 14. In addition, the vibratory tools 40 may be activated at different times. In one example, the lower vibratory tool 40 may be activated first, the upper frac plug 44 may be drilled through, and then the upper vibratory tool 40 may be activated prior to drilling through the lower frac plug 44. However, it should be clearly understood that the scope of this disclosure is not limited to activating vibratory tools at different times, in any particular sequence, before or after drilling through any frac plugs, or before or after extending a tubular string into a horizontal section of a wellbore.

In some examples, the vibratory tools 40 may be activated at different times by providing the vibratory tools with seats designed to sealingly engage plugs of different sizes. For example, the lower vibratory tool 40 may have a seat designed to engage a smaller size plug as compared to a seat of the upper vibratory tool 40. In this manner, a plug sized to engage the seat of the lower vibratory tool 40 can be deployed into the tubular string 12 in order to activate the lower vibratory tool, and then at a later time another (e.g., larger diameter) plug sized to engage the seat of the upper vibratory tool 40 can be deployed into the tubular string in order to activate the upper vibratory tool.

In some situations in which the tubing section 36 comprises continuous tubing (such as, coiled tubing (CT)), connecting the tubing between the bottom hole assemblies 32, 34 while running in can be problematic. For example, tightening a connector 48 at an upper end of the bottom hole assembly 34 could result in unthreading a connector 48 at a lower end of the bottom hole assembly. It would be desirable to be able to connect the bottom hole assembly 34 at each of its ends, without causing rotation of the opposite end.

Figure 2:
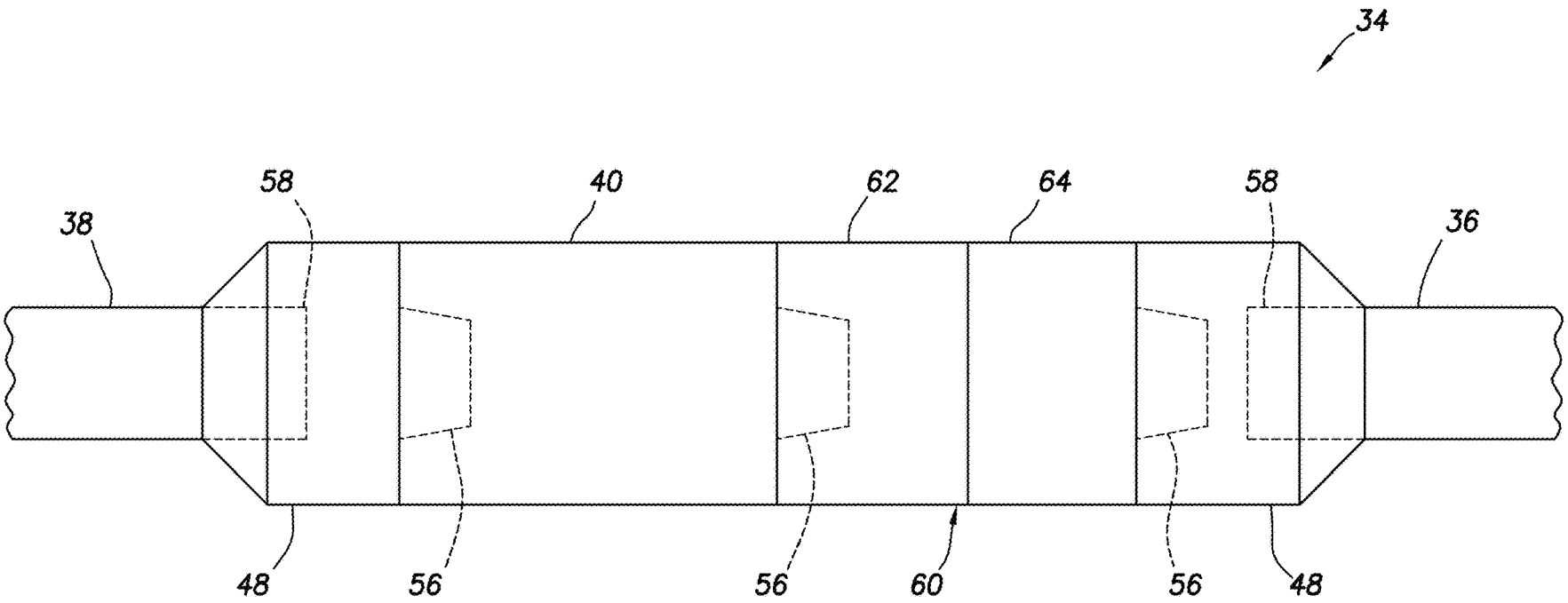
FIG. 2 is a representative side view of an example of a bottom hole assembly that may be used with the FIG. 1 system and method.

Referring additionally now to FIG. 2, a representative side view of an example of a bottom hole assembly 34 that may be used with the FIG. 1 system 10 and method is depicted. For convenience, the FIG. 2 bottom hole assembly 34 is described below as it may be used for the bottom hole assembly 34 in the FIG. 1 system 10 and method, but it should be understood that the FIG. 2 bottom hole assembly may be used in other systems and methods.

In the FIG. 2 example, the bottom hole assembly 34 includes the vibratory tool 40 connected between the tubing connectors 48 at opposite ends of the bottom hole assembly. The tubing connectors 48 are connected in the bottom hole assembly 34 with threaded connections 56. The tubing sections 36, 38 are connected at opposite ends of the bottom hole assembly 34 with slip-type connections 58. In other examples, the bottom hole assembly 34 may include other or different numbers or arrangements of tools in other examples.

To avoid substantial rotation of one end of the bottom hole assembly 34 when the threaded connection 56 at the opposite end of the bottom hole assembly is tightened, the bottom hole assembly includes a connecting tool 60. The connecting tool 60 includes an upper section 62 that is connected with a threaded connection 56 to the vibratory tool 40, and a lower section 64 that is connected with a threaded connection 56 to the lower tubing connector 48. The sections 62, 64 are then connected to each other, without requiring significant rotation between the sections, as described more fully below.

Figure 3A:
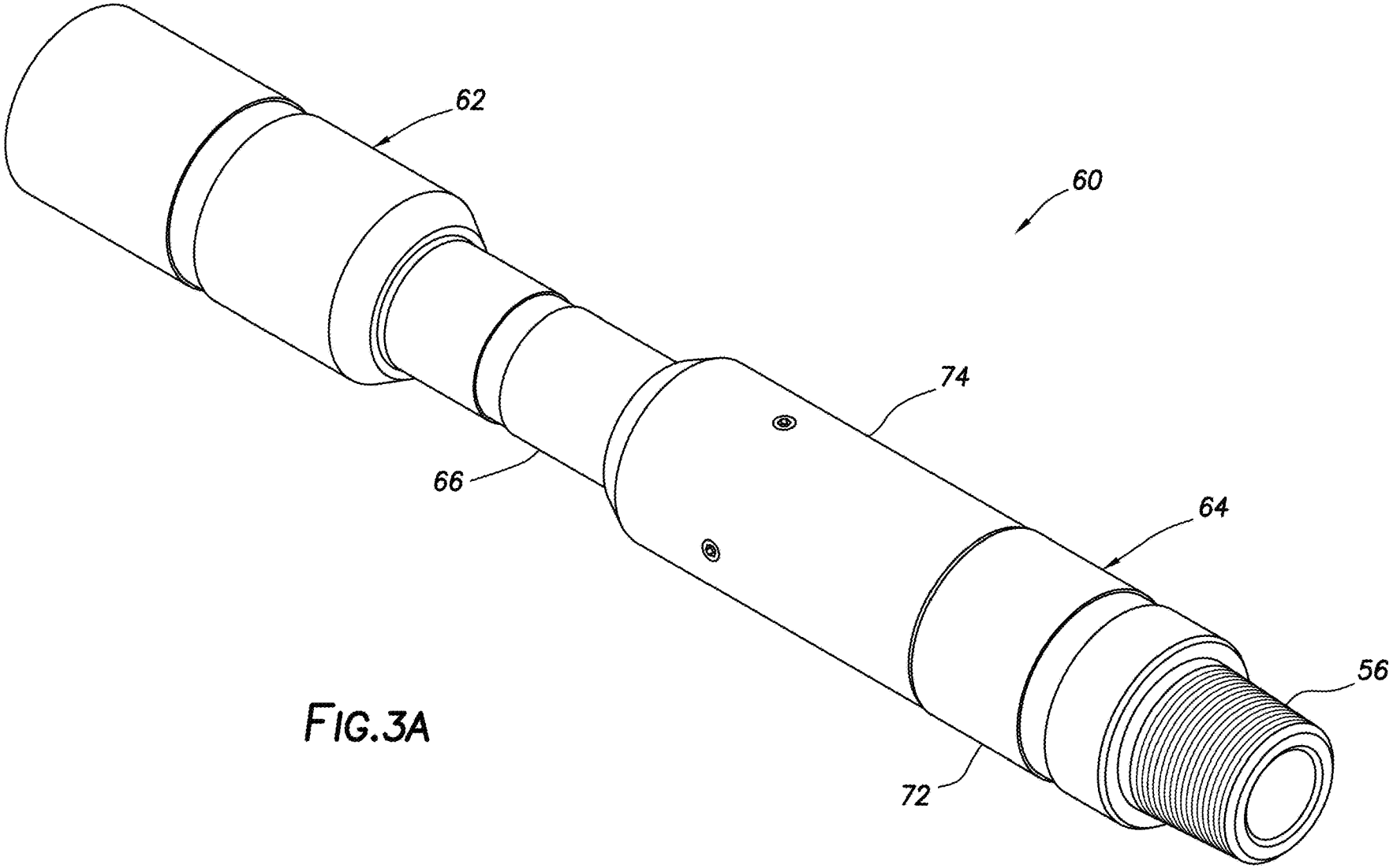
FIG. 3A is a representative perspective view of an example of a connecting tool that may be used in the FIG. 2 bottom hole assembly.
Figure 3B:
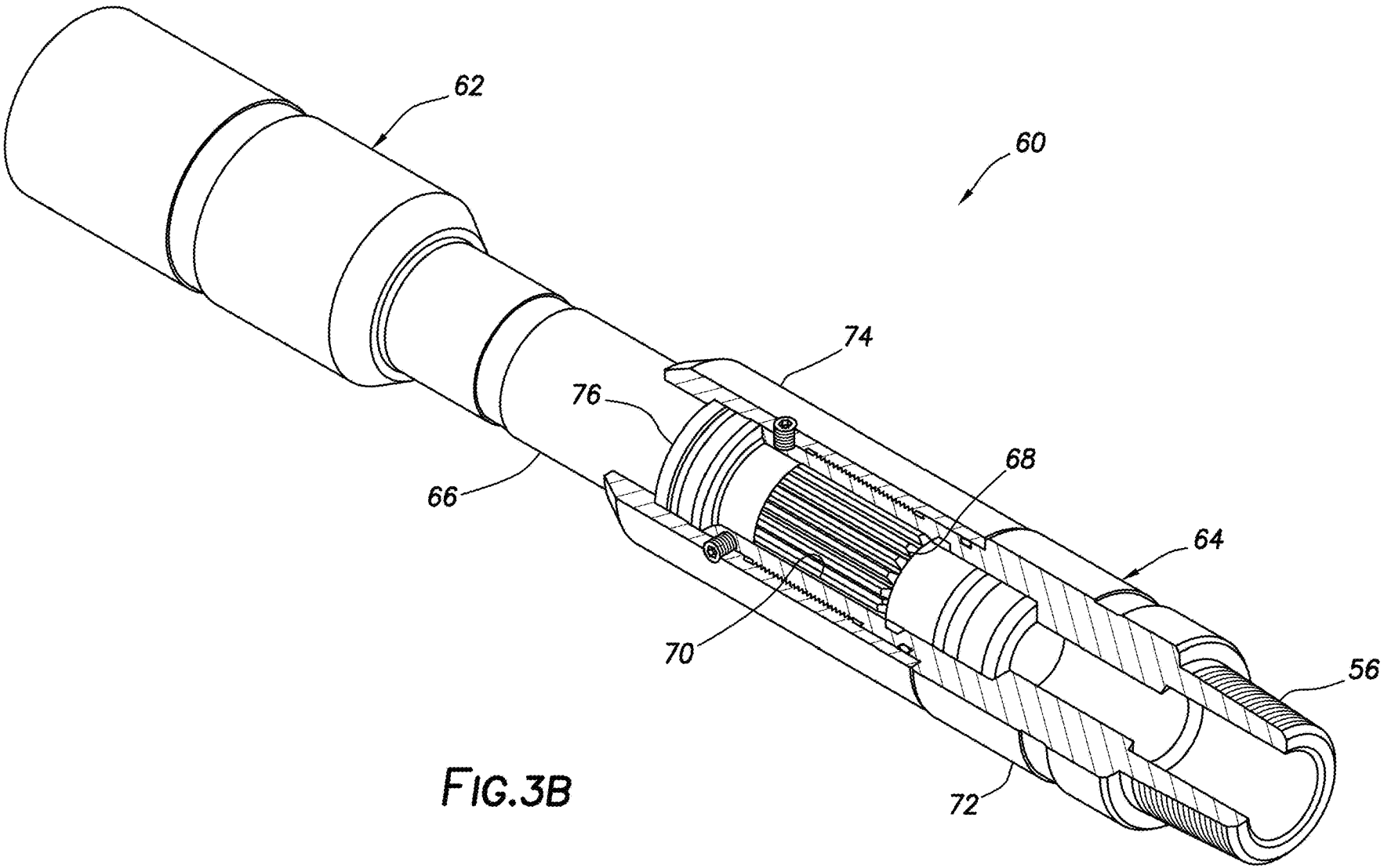
FIG. 3B is a representative partially cross-sectional perspective view of the connecting tool.
Figure 3C:
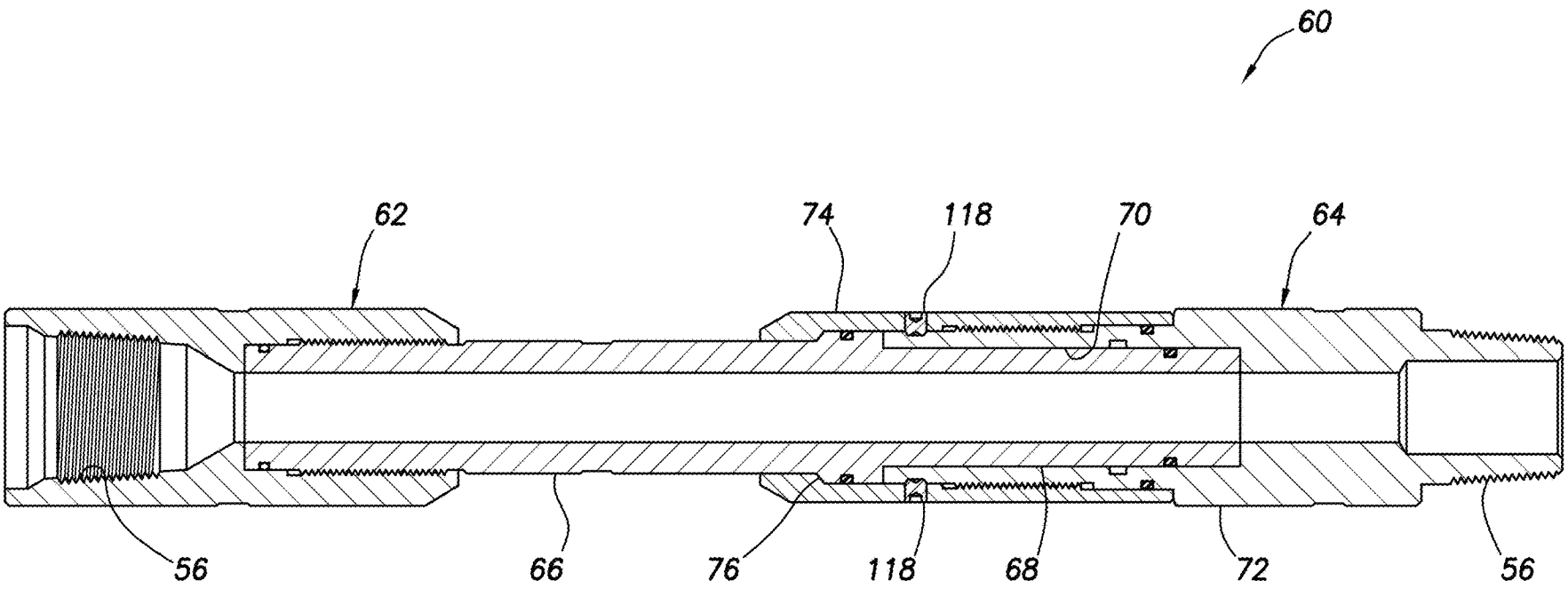
FIG. 3C is a representative cross-sectional view of the connecting tool.

Referring additionally now to FIGS. 3A-C, a representative perspective and cross-sectional views of an example of a connecting tool 60 that may be used in the FIG. 2 bottom hole assembly 34 are depicted. For convenience, the FIGS. 3A-C connecting tool 60 is described below as it may be used in the FIG. 1 or 2 bottom hole assembly 34, but the FIGS. 3A-C connecting tool may be used in other bottom hole assemblies in keeping with the principles of this disclosure.

As depicted in FIGS. 3A-C, the connecting tool 60 includes the upper section 62 and the lower section 64. Each of the upper and lower sections 62, 64 includes a threaded connection 56 for connecting the tool 60 in the bottom hole assembly 34. Other types of connections may be used in other examples.

In this example, the upper section 62 includes a generally tubular inner mandrel 66. External splines 68 are formed on the inner mandrel 66 for cooperative engagement with internal splines 70 formed in a housing 72 of the lower section 64. The engagement between the splines 68, 70 provides for transmission of torque between the upper and lower sections 62, 64.

The upper section 62 further includes an internally threaded outer sleeve 74, which is threaded onto the externally threaded housing 72. A shoulder 76 formed on the inner mandrel 66 prevents separation of the inner mandrel from the housing 72 when the outer sleeve 74 is fully threaded onto the housing. Thus, the threaded engagement of the sleeve 74 with the housing 72 provides for transmission of axial loads between the upper and lower sections 62, 64.

When the connecting tool 60 is initially connected in the bottom hole assembly 34, the upper section 62 is separated from the lower section 64 (the sleeve 74 is unthreaded from the housing 72 and the splines 68, 70 are disengaged). In this manner, the upper section 62 can be connected to an upper portion of the bottom hole assembly 34, and the lower section can be connected to a lower portion of the bottom hole assembly (for example, via the threaded connections 56). The upper and lower sections 62, 64 can then be connected to each other by engaging the splines 68, 70 and threading the sleeve 74 onto the housing 72.

These steps can be accomplished without requiring significant rotation of either of the tubing sections 36, 38. The only rotation that may be required will be to align the splines 68, 70, which will not require significant rotation of either of the tubing sections 36, 38.

Figure 4:
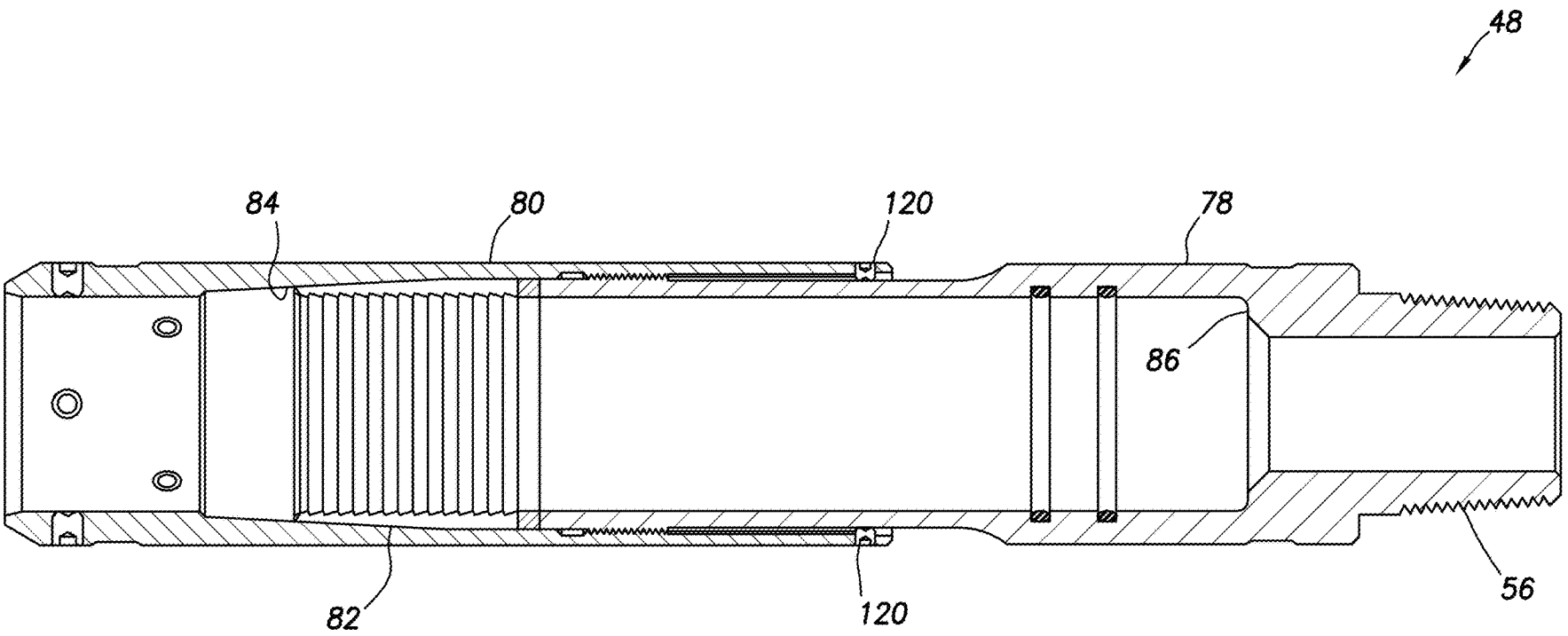
FIG. 4 is a representative cross-sectional view of an example of a coiled tubing connector that may be used in the FIG. 2 bottom hole assembly.

Referring additionally now to FIG. 4, a representative cross-sectional view of an example of a coiled tubing connector 48 that may be used in the FIG. 2 bottom hole assembly 34 is depicted. For convenience, the tubing connector 48 is described below as it may be used with the FIG. 2 bottom hole assembly 34.

The tubing connector 48 includes a housing 78 and an outer sleeve 80, which is threaded onto the housing. Slips 82 at an upper end of the housing 78 are dimensioned to grip an outer surface of the tubing section 36 or 38. An inner surface 84 of the outer sleeve 80 is tapered, so that the slips 82 are increasingly deflected inward into gripping engagement with the tubing section 36 or 38 as the outer sleeve is further threaded onto the housing 78.

In practice, the tubing section 36 or 38 is inserted through the sleeve 80 and into the housing 78, until the tubing section abuts an internal shoulder 86 in the housing. The sleeve 80 is then tightened onto the housing 78, so that the slips 82 grip the outer surface of the tubing section 36 or 38.

Preferably, a tensile load is then applied to the tubing section 36 or 38 and the tubing connector 48, so that the slips 82 are fully grippingly engaged with the outer surface of the tubing section 36 or 38. At this point, the slips 82 can be axially separated somewhat from the upper end of the housing 78. To eliminate any gap between the slips 82 and the housing 78, the tensile load can be removed, and the outer sleeve 80 can be further tightened onto the housing.

Figure 5:
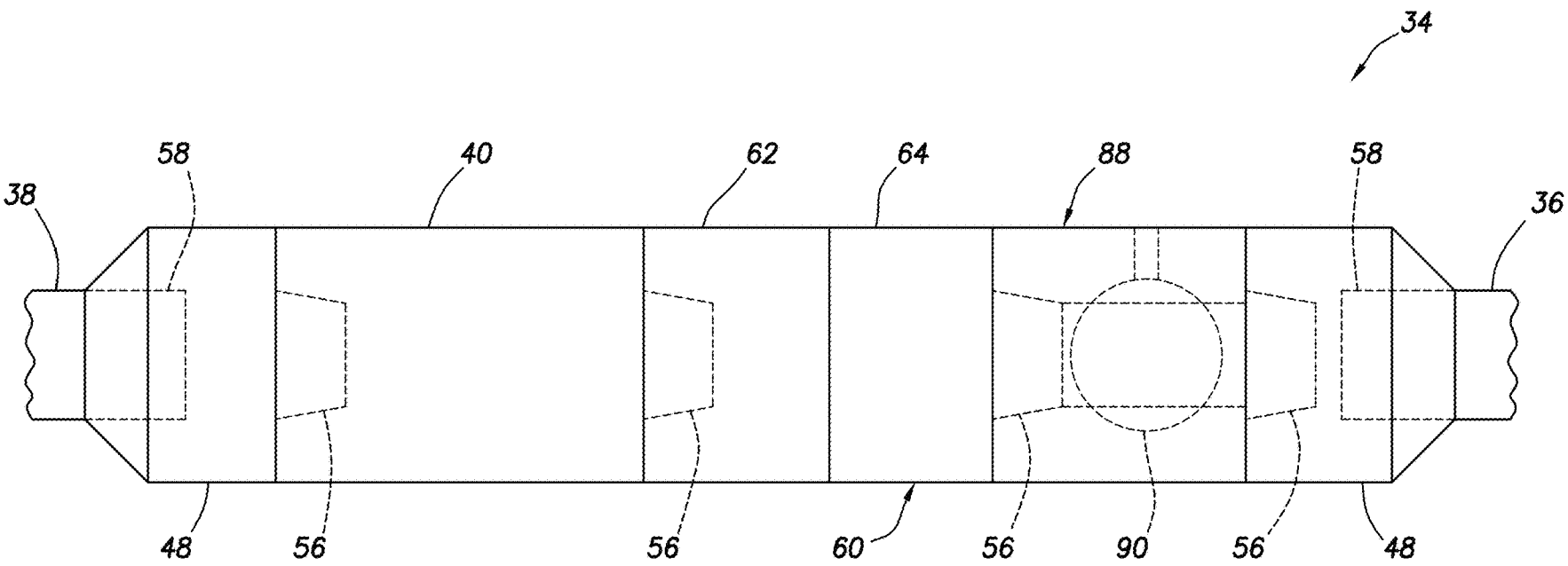
FIG. 5 is a representative side view of another example of the bottom hole assembly.

Referring additionally now to FIG. 5, a representative side view of another example of the bottom hole assembly 34 is depicted. In this example, the bottom hole assembly 34 includes a valve 88 that can be closed when the tubular string 12 is retrieved from the well, in order to prevent release of any pressure in the lower tubing section 36 as it is brought to the surface.

As depicted in FIG. 5, the valve 88 is connected between the connecting tool 60 and the lower tubing connector 48. In this manner, the upper tubing section 38 and the upper portion of the bottom hole assembly 34 (including the upper section 62 of the tool 60 and components above) can be readily disconnected from the lower portion of the bottom hole assembly after the valve 88 has been closed. In other examples, the valve 88 may be connected at other locations in the bottom hole assembly 34.

In the FIG. 5 example, the valve 88 includes a closure member 90 in the form of a rotatable ball. The closure member 90 is depicted in an open position in FIG. 5.

The closure member 90 can be displaced to a closed position from an exterior of the valve 88. In other examples, other types of closure members (such as, a rotatable plug, a flapper, a gate, etc.) may be used.

Figure 6:
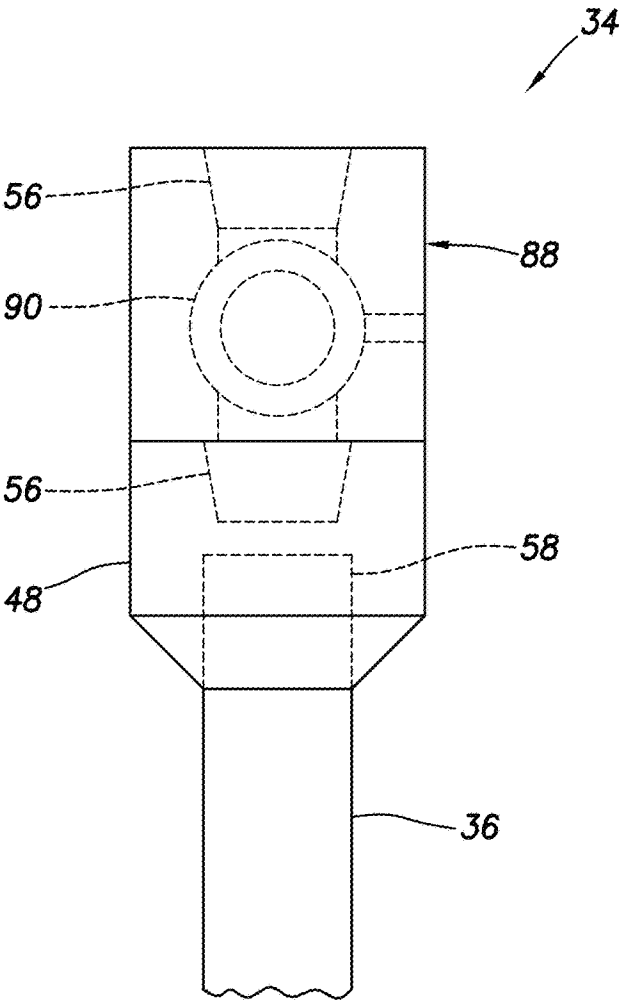
FIG. 6 is a representative side view of the FIG. 5 bottom hole assembly with an upper portion of the bottom hole assembly removed.

Referring additionally now to FIG. 6, a representative side view of the FIG. 5 bottom hole assembly 34 with an upper portion of the bottom hole assembly removed is depicted. The closure member 90 has been displaced to its closed position as shown in FIG. 6.

Note that the connecting tool 60 (including both of the upper and lower sections 62, 64) is not depicted in FIG. 6. However, as discussed above, the lower section 64 of the connecting tool 60 may remain connected to the valve 88 after the valve is closed and the upper portion of the bottom hole assembly 34 has been removed.

In its closed position, the closure member 90 prevents inadvertent release of pressure from the lower tubing section 36. Such pressure may exist in the lower tubing section 36, for example, due to a leak in the lower bottom hole assembly 32, a pinhole in the lower tubing section, a failed seal in any component below the valve 88, etc.

Figure 7:
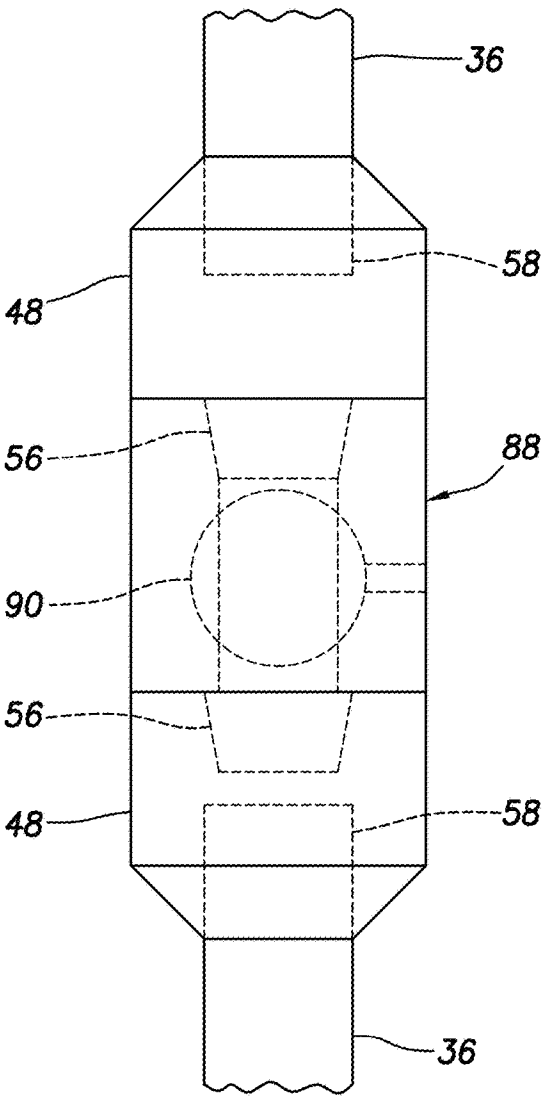
FIG. 7 is a representative side view of an example of an isolation valve that may be used with the FIG. 2 bottom hole assembly.

Referring additionally now to FIG. 7, a representative side view of an example of an isolation valve 88 that may be used with the FIG. 2 bottom hole assembly 34 is depicted. However, in this example the valve 88 is not connected as part of the bottom hole assembly 34.

Instead, the valve 88 is connected between upper and lower portions of the tubing section 36 below the bottom hole assembly 34. Otherwise, the FIG. 7 valve 88 functions in a manner similar to that described above for the FIGS. 5 & 6 example.

Figure 8B:
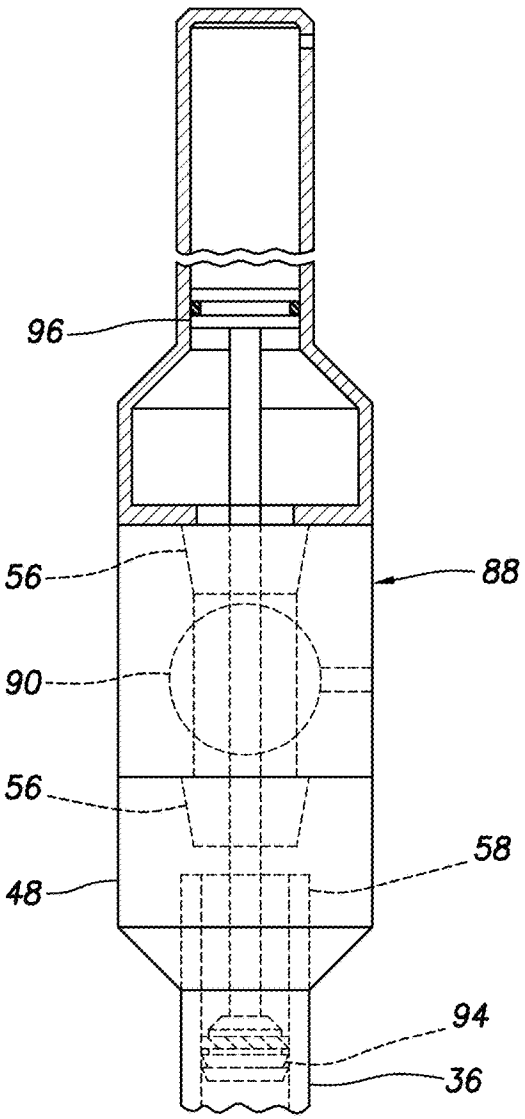
FIG. 8B is a representative partially cross-sectional view of the isolation valve in an open configuration with a plug installed therethrough.
Figure 8A:
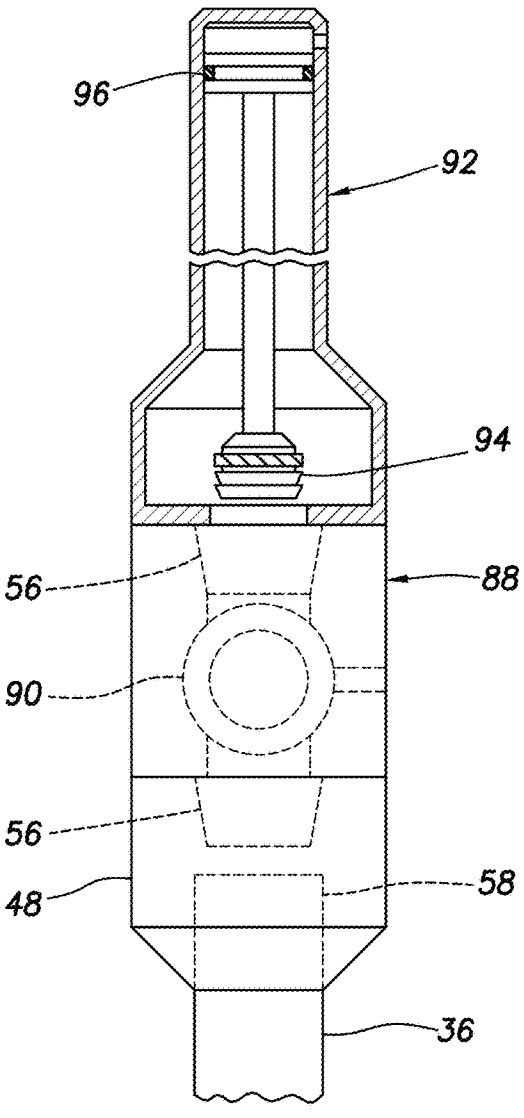
FIG. 8A is a representative partially cross-sectional view of the isolation valve with an example of a plug installation tool attached thereto.

Referring additionally now to FIGS. 8A & B, representative partially cross-sectional views of the isolation valve 88 are depicted. In FIG. 8A, an example of a plug installation tool 92 is attached to the valve 88. In FIG. 8B, the valve 88 is in an open configuration with a plug 94 installed therethrough.

As depicted in FIG. 8A, the upper tubing connector 48 and the upper portion of the tubing section 36 have been removed at the surface after the valve 88 has been closed. Alternatively, if the valve 88 is connected as part of the bottom hole assembly 34 as in the FIG. 5 example, the tubing section 38 and the upper portion of the bottom hole assembly 34 have been removed after the valve 88 has been closed.

In this example, the plug installation tool 92 includes a piston 96 connected to the plug 94. After the plug installation tool 92 has been connected above the valve 88, the valve can be opened as depicted in FIG. 8B, without allowing inadvertent release of the pressure in the tubing section 36 below the valve.

Pressure can then be applied to the piston 96 to displace the plug 94 into the tubing section 36, and the plug can be set in the tubing section 36. This will allow the valve 88, the tubing connector 48 and the plug installation tool 92 to be disconnected from the tubing section 36, without releasing the pressure from the tubing section. The tubing section 36 can then be retrieved from the well using normal tubing retrieval practices.

Figure 9:
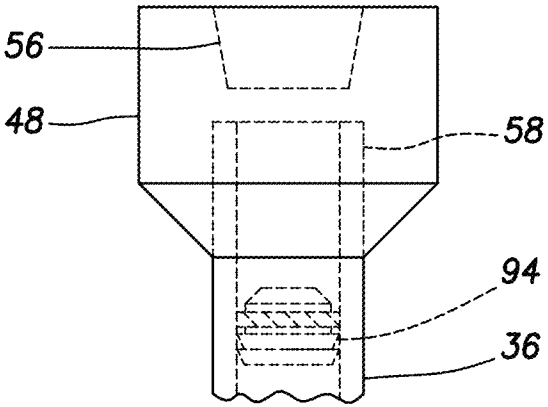
FIG. 9 is a representative side view of the plug installed in a tubing section downhole of a tubing connector.

Referring additionally now to FIG. 9, a representative side view of the plug 94 installed in the tubing section 36 downhole of the lower tubing connector 48 is depicted. In this view, the valve 88 and plug installation tool 92 have been removed from the lower tubing connector 48.

Figure 10:
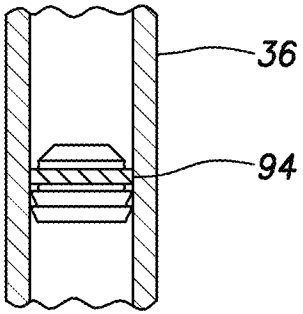
FIG. 10 is a representative side view of the plug installed in the tubular string with the isolation valve and tubing connector removed.

Referring additionally now to FIG. 10, a representative side view of the plug 94 installed in the tubing section 36, and with the isolation valve 88 and lower tubing connector 48 removed, is depicted. In this configuration, the tubing section 36 can be retrieved from the well with standard tubing handling equipment (such as, the FIG. 1 coiled tubing rig 98 including the gooseneck guide 20, injector 22, BOP stack 24, lubricator 26, etc.).

Figure 11:
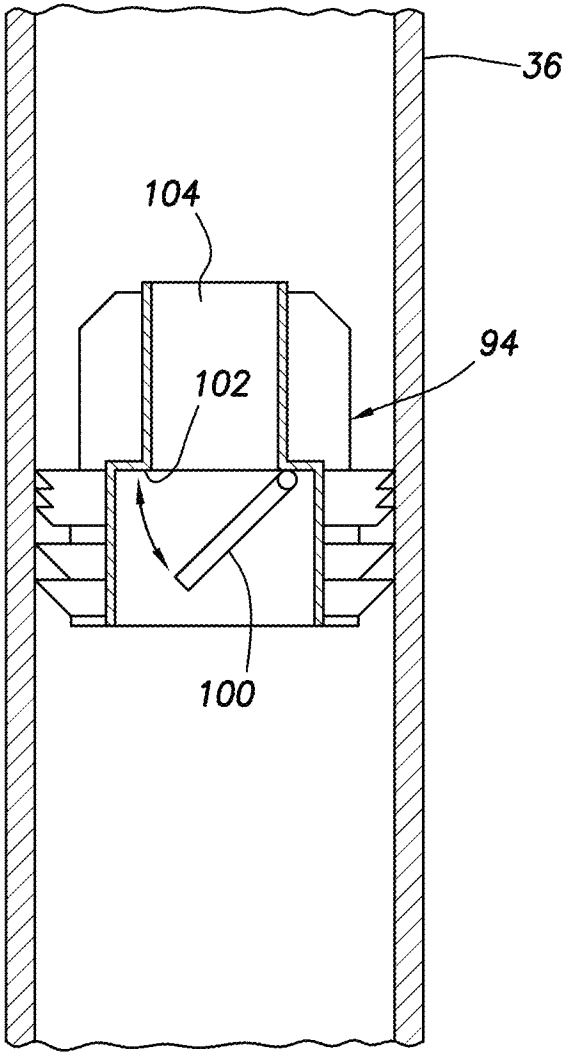
FIG. 11 is a representative cross-sectional view of another example of the plug installed in the tubular string.

Referring additionally now to FIG. 11, a representative cross-sectional view of another example of the plug 94 installed in the tubing section 36 is depicted. In this example, the plug 94 includes a check valve 100 in the form of a flapper that engages a seat 102 that encircles a flow passage 104 formed through the plug 94.

The check valve 100 permits fluid flow into the tubing section 36 below the plug 94, but prevents flow in an opposite direction. In this manner, fluid can be circulated into the tubing section 36 below the plug 94, without allowing inadvertent release of the pressure in the tubing section.

Figure 12:
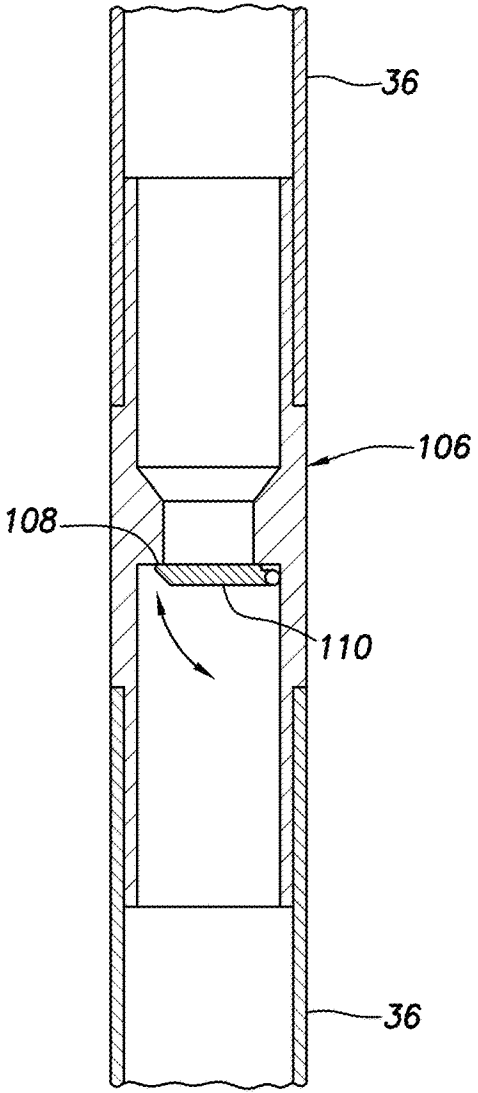
FIG. 12 is a representative cross-sectional view of an example of a flapper-type check valve that may be used with the FIG. 2 bottom hole assembly.

Referring additionally now to FIG. 12, a representative cross-sectional view of an example of a flapper-type check valve 106 that may be used with the FIG. 2 bottom hole assembly 34. The check valve 106 may be connected as part of the bottom hole assembly 34 (as with the valve 88 in the FIG. 5 example), or the check valve 106 may be connected downhole of the bottom hole assembly 34 (as with the valve 88 in the FIG. 7 example).

One advantage of use of the FIG. 12 check valve 106 is that it is "spoolable" in that it is configured to be able to pass through the injector 22, over the gooseneck 20 and be wound onto the reel 18. Thus, there is no need for special handling equipment to be utilized when retrieving the check valve 106 and the tubing section 36.

For this purpose, the check valve 106 may have an outer diameter that is the same, or substantially the same, as that of the tubing section 36. Internal components of the check valve 106 (such as, a flapper 110 and seat 108) may be specially constructed to withstand bending of the check valve over the gooseneck 20 and around the reel 18, while still preventing release of pressure from the lower tubing section 36 during retrieval.

As with the FIG. 11 plug 94, the FIG. 12 check valve 106 permits fluid flow into the tubing section 36 below the check valve, but prevents flow in an opposite direction. In this manner, fluid can be circulated into the tubing section 36 below the check valve 106, without allowing inadvertent release of the pressure in the tubing section.

Figure 13:
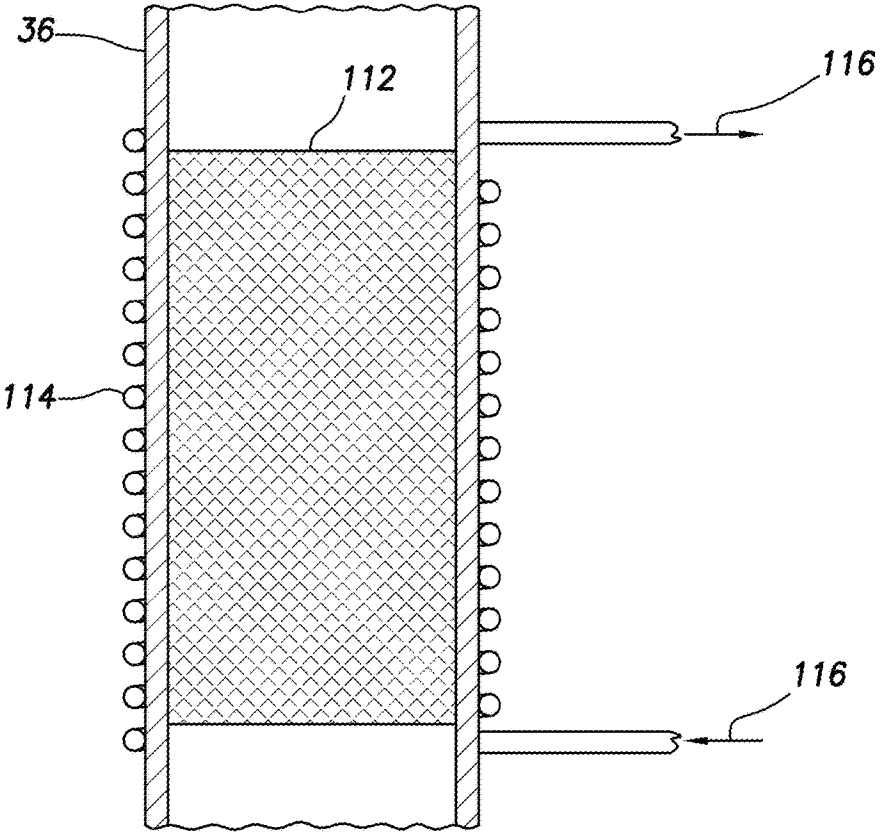
FIG. 13 is a representative cross-sectional view of an example of a frozen plug installed in the tubular string.

Referring additionally now to FIG. 13, a representative cross-sectional view of an example of a frozen plug 112 installed in the tubing section 36 is depicted. In this example, the frozen plug can be formed in the tubing section 36 below the bottom hole assembly 34 when at least an upper end of the tubing section 36 has been retrieved to the surface.

Tubing 114 is wrapped about the tubing section 36 at a location where formation of the plug 112 is desired. A liquid, gel or slurry is placed in the tubing section 36 at the desired location. Refrigerant 116 is circulated through the tubing 114, thereby causing the liquid, gel or slurry in the tubing section 36 to freeze and form the plug 36. The tubing section 36 can then be retrieved from the well, without inadvertent release of the pressure in the tubing section 36 below the plug.

Disclosed herein is a system 10 and method for advancing a tubular workstring (such as the tubular string 12) into a wellbore 14. In one example, a lower bottom hole assembly (BHA) 32 including a vibratory tool 40 is attached to a section 36 of jointed pipe. The top of the jointed pipe section 36 is attached to a bottom of a mid-string BHA 34 which includes a vibratory tool 40. The top of the mid-string BHA 34 is attached to a section 38 of coiled tubing (CT) which runs from the surface to the mid-string location. The vibratory tool 40 which is placed in between the different sections of tubing 32, 34 provides improved vibration of the tubular string 12 for more effective friction reduction in the entire tubular string.

An example of this arrangement is depicted in FIG. 1. In other examples, the tubular string 12 could include multiple sections of coiled tubing and/or jointed pipe, with or without vibratory tools 40 between different tubing sections.

Method 1 Example:

1. Use a snubbing unit, rig 30, or other surface system which is suitable for running jointed pipe into a well to deploy a BHA 32 (for example, a motor BHA suitable for drilling frac plugs 44 out) on jointed pipe for a distance into the wellbore 14. Variations of this step can include:
   a. Running a sufficient amount of jointed pipe into the well to ensure the jointed pipe has sufficient weight to create a "pipe-heavy" condition for the existing well conditions (wellhead pressure, buoyancy, etc.). This enhances safety by avoiding reliance on reverse direction slips to keep the tubing from being blown out of the well when disconnected from surface handling equipment.
   b. Running a sufficient length of jointed tubing to ensure that the second vibratory tool 40 is located beyond the vertical section of the well before plug milling, well drilling or other operations commence.

c. Running a vibratory tool 40 in the lower BHA 32. This tool 40 can be a vibratory tool that is activated when desired, for instance by dropping a ball to activate it.

2. Hang the jointed tubing section 36 off at the surface.
3. Move the jointed pipe handling system (e.g., rig 30) out of the way.
4. Move a coiled tubing handling system such as a standard CT rig 98 onto the well.
5. Install a second BHA 34 between the jointed tubing section 36 and the CT section 38. This BHA 34 can comprise appropriate components, such as, coiled tubing (CT) connector 48, back pressure valves, vibratory tool 40, jointed tubing connector 48.
6. Advance the tubular string 12 into the well using appropriate CT handling unit 98. Variations of this step can include:
   a. Running in at a reduced pump rate to avoid excessive vibration of the tubular string 12 until the tubular string is sufficiently advanced into the wellbore 14.
   b. Running a vibratory tool 40 in the mid-string BHA 34 that can be activated when desired, for example, by dropping a ball, dart or other plugging device. This tool 40 can also be configured so that a ball or other activation method can pass through or otherwise not activate the mid-string vibratory tool 40, but will activate the lower BHA vibratory tool 40.
7. Conduct well operations such as drilling plugs 44, drilling the wellbore 14 further, etc. Variations of this step can include:
   a. Activating the lower vibratory tool 40 as desired to reduce friction between the tubular string 12 and wellbore 14, or otherwise enhance the operation.
   b. Activating the upper vibratory tool 40 as desired to reduce friction between the tubular string 12 and wellbore 14, or otherwise enhance the operation.
8. Withdrawing the CT section of tubing 38 from the well.
9. Bleeding down pressure from CT section 38, mid-string BHA 34 and jointed pipe section 36 as needed.
10. Rigging up a jointed pipe handling rig 30 (snubbing unit, CT unit, etc.) and removing the jointed pipe section 36 and lower BHA 32 from the well.

Method 2 Example:

1. Utilize the steps 1-3 from method 1 above sequentially on multiple wellbores 14 on a location (such as, a multi-well pad). This will result in a lower BHA 32 and jointed pipe section 36 being deployed into each of the multiple wellbores 14.
2. Utilize steps 4-9 from method 1 above on all wellbores 14 to which step 1, method 2 was applied. This will leave jointed pipe sections 36 and lower BHAs 32 in the multiple wellbores 14, but with well operations completed (for example, plugs 44 drilled out).
3. Utilize step 10 from method 1 above on all wellbores 14 to which step 2, method 2 was applied.

Method 3 Example:

1. Utilize the steps 1-3 from method 1 above on multiple wellbores 14 on a location (such as, a multi-well pad).
2. Utilize steps 1-3 from method 1 on a next sequential wellbore 14 on the location while simultaneously applying steps 9-10 to the wellbore 14 treated in step 1 of method 3.
3. Repeat step 1 and 2 of method 3 until operations in all wellbores 14 are completed.

In another aspect of this disclosure, methods for making a mid-string connection between two sections of coiled tubing 36, 38, and installing a mid-string BHA 34 between the two sections of CT are described herein. Coiled tubing is terminated with a connector 48 of a type which provides a threaded connection 56 opposite the coiled tubing. This allows downhole tools, etc., which typically have threaded tool-joint connections, to be securely attached to the CT.

In a situation where two opposing CT sections 36, 38 are to be connected with a BHA 34 installed in between, a CT connector 48 is installed on both CT sections 36, 38 with the BHA 34 installed between the connectors 48. One problem with having two opposing CT sections 36, 38 with standard threaded connections 56, in between which a BHA 34 will be installed, is that only one side can be made-up because each end of the BHA cannot be tightened without backing the other side off. It is desirable to use standard BHA components which have right-hand threaded connections on top and bottom. For at least this reason, a method of connecting two sections of CT 36, 38 with a BHA 34 installed in between is provided to the art herein.

FIG. 2 depicts an example of a connection in which two CT sections 36, 38 have been attached with a BHA 34 installed in between. In this connection, a connecting tool 60 has been used that does not require rotation in order for a secure, leak-proof, high-tensile, high-torque connection to be made. This allows standard threaded BHA components to be used.

FIGS. 3A-C depict an example of a specific connecting tool 60 design that can be used in the FIG. 2 assembly. This connecting tool 60 has an upper section 62 which makes a sliding, splined engagement with a lower section 64. An outer sleeve 74 has a threaded engagement with the housing 72 and a surface contact engagement with the shoulder 76.

When the upper section 62 is slid into the lower section 64 with the splines 68, 70 engaged, and the sleeve 74 is securely threaded on the housing 72, a secure, leak-proof, high-tensile, high-torque connection is made. Set screws 118 can be used which engage the sleeve 74 and the housing 72, and which keep the sleeve from unthreading from the lower section 64.

This connecting tool 60 allows the top and bottom CT connectors 48 to be installed on the upper and lower CT sections 36, 38 independently. The upper and lower CT sections 36, 38 can then be connected by "stabbing" the upper connecting tool section 62 into the lower connecting tool section 64, without requiring significant rotation. The sleeve 74 and set screws 118 of the connecting tool 60 can then be secured to complete the connection.

One beneficial feature of this connecting tool 60 example is the use of relatively fine splines 68, 70, such that when the upper and lower sections 62, 64 are "stabbed" together, very little relative rotation between the connecting tool sections is required in order for the splines to align during assembly.

One example of a CT connector 48 (e.g., a slip-type connector) is depicted in FIG. 4. With this connector 48, the end of a CT section 36, 38 is inserted into the open end of the connector and pushed all the way into the connector until it abuts the shoulder 86. The housing 78 and sleeve 80 then threaded together with sufficient torque to cause the slips 82 to engage the CT section 36, 38.

The housing 78 is then secured at a bottom of the lubricator 26 on the CT surface equipment and the CT string 12 is subjected to a significant tensile load to "set" the slips 82 into the outer surface of the CT within the connector 48.

This process causes a gap to form between the bottom end of the slips 82 and the upper end of the housing 78 as the slips "bite" into the CT.

The tensile load is then relieved, and the housing 78 is tightened into the sleeve 80 until the gap which was formed during the tensile loading is closed. The housing 78 is then secured against further rotation with set screws 120. At this point the connector 48 is fully installed onto the coiled tubing and is ready to be run.

When two opposing slip-type connectors 48 are used to connect two CT sections 36, 38 as described previously, an operator would not be able to "re-tighten" the sleeves 80 and housings 78 of the two connectors after setting the slips 82 using tensile loading as described above. A connecting tool 60 which provides the functionality of the one described above and depicted in FIGS. 3A-C can be used to overcome the problem with "re-tightening" opposing slip-type connectors 48.

The following example process can be used with the FIGS. 3A-C connecting tool 60:

1. Install a CT connector 48 to the upper section of CT 38 and apply enough torque to components to cause the slips 82 to engage the CT.
2. Install a CT connector 48 to the lower section of CT 36 and apply enough torque to the components to cause the slips 82 to engage the CT.
3. If other threaded BHA 34 components are to be installed between the sections of CT 36, 38, they are made up to the top or bottom CT connectors 48 at this point.
4. Install the upper section 62 of a stab-type connecting tool 60 (e.g., the example depicted in FIGS. 3A-C) to the connector 48 or BHA 34 which was installed on the upper section of CT 38 in step 1.
5. Install the lower section 64 of the stab-type connecting tool 60 (e.g., the example depicted in FIGS. 3A-C) to the connector 48 or BHA 34 which was installed on the lower section of CT 36 in step 2.
6. Stab the connecting tool sections 62, 64 together and tighten the sleeve 74 to secure the connecting tool sections together.
7. Use the CT rig 98 to pull tension on the two CT connectors 48 and the connecting tool 60 assembly to "set" both sets of slips 82 on the upper and lower sections of CT 36, 38.
8. Remove the tension on the assembly.
9. Remove the sleeve 74 on the connecting tool 60 and separate the upper and lower connecting tool sections 62, 64.
10. Re-tighten the appropriate components (e.g., the housing 78 and sleeve 80) within the two connectors 48 to close the gap which was formed between the slips 82 and the housing 78 during the "setting" of the slips with the tensile load. This requires rotating components in each connector 48 assembly independently in this example.
11. Tighten the sleeve 80 on both slip-type connectors 48 and install the set screws 120 to complete the installation.
12. If tools in the BHA 34 need to be added or removed at this point, the connecting tool 60 may be disassembled so that the upper and lower CT string sections 36, 38 can be separated and threaded connections 56 in the mid-string BHA made up or broken out to add or remove tools from the BHA as needed.
13. The connecting tool 60 can then be stabbed and secured as previously described.

The present disclosure can provide significant benefits, for example, in well operations in which frac plugs 44 are drilled out after fracturing or other stimulation operations. Typically, the frac plugs 44 are set in a horizontal or lateral section of wellbore 14 downhole of a vertical section extending to the surface. It would be desirable in some cases to be able to connect multiple vibratory tools 40 in a CT string 12, without having to retrieve the tubular string to the surface.

In this example of drilling out frac plugs 44 using a CT string 12 having multiple vibratory tools 40 connected therein, the vibratory tools may operate to produce vibrations in response to fluid flow through the tubular string. In some examples, the vibratory tools 40 (or any of them) may be activated downhole, so that the vibrations may be produced when desired (e.g., by deploying a ball, dart or plug into the tubular string). In some examples, the vibratory tools 40 may be de-activated downhole (e.g., by deploying another ball, dart or plug into the tubular string).

In some examples, different plugs may be used to activate or de-activate selected vibratory tools 40. For example, a first, relatively small plug may be deployed into the tubular string to cause a farthest downhole vibratory tool 40 to be activated, and a second, larger plug may be deployed into the tubular string to cause a further uphole vibratory tool 40 to be activated. The farthest downhole vibratory tool 40 may have a plug seat that is smaller than a plug seat of the further uphole vibratory tool 40.

When activated, the vibratory tools 40 produce vibrations in the tubular string in response to fluid flow through the tubular string. Some suitable examples of vibratory tools that may be used include, but are not limited to, those described in U.S. Pat. No. 10,724,318 and U.S. application Ser. No. 18/664,555 filed on 15 May 2024, the entire disclosures of which are incorporated herein by this reference for all purposes.

In one example method, a CT string 12 may be deployed into a wellbore 14. The CT string 12 includes a first BHA 32 at its distal end. The first BHA 32 includes a fluid motor 46 (such as, a Moineau-type "mud" motor), a mill or drill bit 42 suitable for drilling (or milling) out frac plugs 44, and a first vibratory tool 40. A first CT section 36 is connected between the first BHA 32 and a second BHA 34.

The second BHA 34 includes a second vibratory tool 40. A second CT section 38 is connected between the second BHA 34 and the surface. The first and second BHA's 32, 34 and the first and second CT sections 36, 38 are run into the wellbore 14, without retrieving any part of the tubular string 12 to surface (that is, in a single trip into the wellbore 14).

A first frac plug 44 is drilled out using the CT string 12. Fluid flow through the CT string 12 causes the fluid motor 46 to rotate the mill or drill bit 42, so that the first frac plug 44 is drilled through. In this example, neither of the vibratory tools 40 is activated prior to drilling out the first frac plug 44. However, both of the first and second vibratory tools 40 are connected in the CT string 12 when the first frac plug 44 is drilled out.

After the first frac plug 44 is drilled out, the first vibratory tool 40 is activated. For example, a suitable plug may be deployed into the tubular string 12 and circulated with fluid flow to the first vibratory tool 40. Once activated, the first vibratory tool 40 produces vibrations in the CT string 12 in response to the fluid flow.

Note that the first vibratory tool 40 may be activated at any point after the first frac plug 44 is drilled out. For example, the first vibratory tool 40 may be activated after the first frac plug 44 is drilled out, but before a second frac plug 44 has been drilled out, or the first vibratory tool 40 may be activated after the second or a subsequent frac plug 44 is drilled out. The scope of this disclosure is not limited to any particular sequence of activating the first vibratory tool 40 and drilling out any particular frac plug(s) 44.

The second vibratory tool 40 is activated after the first vibratory tool 40 is activated in this example. Any number (including zero) of frac plugs 44 may be drilled out between the activations of the first and second vibratory tools 40. The second vibratory tool 40 may be activated by deploying a suitable plug into the CT string 12 and circulating the plug to the second vibratory tool 40 with fluid flow. The plug may be larger than the plug used to activate the first vibratory tool 40.

Thus, in the above example method, multiple vibratory tools 40 can be connected in the CT string 12 prior to drilling out any of the frac plugs 44. The vibratory tools 40 can be selectively activated when needed to aid in advancing the tubular string 12 through the wellbore 14. Beneficially, the fluid flow can be maintained at a sufficiently high level to enable an initial frac plug(s) 44 to be drilled through efficiently, without activating the vibratory tools 40. However, the vibratory tools 40 can be activated when desired.

FIG. 5 depicts another mid-string BHA 34 configuration that includes an isolation valve 88. The isolation valve 88 can be used to isolate the lower tubing section 36 in the event that a leak in the tubing or lower BHA 32 occurs. This valve 88 can be of several different types. In one example, the valve 88 can comprise a ball valve or flapper assembly that can be opened or closed via a surface interface, such as an external "key" which can engage an internal ball valve mechanism to operate the valve 88. Another example technique to operate the internal valve mechanism is to attach an external hydraulic source to an operating area within the isolation valve 88 to create the force required to operate the internal valve mechanism. Another way to operate the internal valve mechanism is to rotate a component that is on the exterior of the isolation valve 88 to shift the internal valve mechanism open or closed.

Another type of valve may be used that is closed by pumping a ball or other plug from the uphole end of the coiled tubing string 12 through the valve 88 to release a restrained flapper valve, so it can shift to a closed position. This type of valve 88 does not require an external interface which engages the outside of the tool in order to operate.

It is desirable for the isolation valve 88 to have a relatively "full-opening" configuration in the open position so that a relatively large ID is obtained. In this case, the isolation valve 88 can be closed and an upper section of the mid-string vibratory tool BHA 34 can be removed. Appropriate surface equipment (tubing, CT unit 98, lubricator 26, etc) can then be attached to the lower CT string 36, so the lower CT can be removed from the well. A "full-opening" isolation valve 88 allows wireline, slickline or fluid conveyed intervention tools to pass through the isolation valve as needed. For example, a tubing cutter might pass through the isolation valve 88 to cut the coiled tubing section 36 below the mid-string BHA 34 location if desired.

FIG. 6 depicts the lower CT section 36, CT connector 48 and closed isolation valve 88 with the upper section of the mid-string BHA 34 removed. FIG. 7 depicts the lower CT section 36, CT connector 48 and open isolation valve 88 with a top CT connector 48 and upper CT section 38 (or another portion of the lower section 36) connected with a full-opening ID.

In another example, one or more plugs 94 are installed near the top of the lower CT section 36 to provide isolation from fluid pressure/flow from the lower CT section. In one method, a plug installation tool 92 is installed above the isolation valve 88. This tool 92 is used to advance an internal plug 94 through the top of the isolation valve 88 and CT connector 48, and into the lower CT section 36. The plug 94 is then "set" inside the CT section 36 to prevent flow from the lower CT section.

This method is depicted in FIGS. 8A & B. FIG. 9 depicts the lower CT section 36 with all components except the CT connector 48 removed.

FIG. 10 depicts the lower CT section 36 with a plug 94 installed and all other components removed from the lower CT section. In this condition the lower CT section 36 can then be connected to a spoolable connector (not shown) used to connect one section of a CT string that is hanging in a well to another CT string that is installed on a CT unit. The spoolable connector has the same OD as the coiled tubing so it can pass through surface CT equipment. Once the spoolable connection is made, the lower CT section 36 can be retrieved from the well and spooled onto a CT reel 18.

The internal CT plug 94 can be solid, or can have a flapper or check valve 100 feature that allows fluid to be pumped from the surface down the CT section 36, but will not allow back-flow from downhole through the plug(s) 94. A pump-through plug 94 of this type is represented schematically in FIG. 11.

Any type of suitable plug design can be used. Setting methods can include tension, compression, rotation, pressure, and/or hydrostatically generated force/motion. Additionally, plug designs that can be retrieved can be utilized.

Another specific method is to install one or more pump-through plug(s) 94 into the lower CT section 36 prior to installing any or all of the mid-string BHA 34 components. This would allow the lower CT section 36 to be cut off uphole of the plug(s) 94 (leaving the condition depicted in FIG. 10), without having to install the plug(s) later in the job sequence as depicted in FIGS. 8-11. This could be done as the lower CT section 36 is being run, when there is not significant well pressure on the lower CT section, allowing the plug(s) to be installed with greater ease and safety.

Specific methods can include:

1. The use of a surface operable isolation valve 88 to isolate the lower CT section 36.
2. The use of a full-opening isolation valve 88 that can be closed when desired.
3. The use of the full-opening isolation valve 88 that can opened when desired.
4. The use of a full-opening isolation valve 88 that can be selectively opened or closed when desired.
5. The use of an isolation valve 88 that can be operated by pumping an activation blocking element through the valve from the surface end of a CT string 12.
6. The use of a ball valve or flapper valve in an isolation valve 88 as described herein.
7. The method of pulling the full CT assembly (upper and lower CT sections 36, 38 and upper and lower BHA's 32, 34) until the mid-string BHA 34 is at the surface.
   a. Then closing the isolation valve 88.
   b. Then removing the mid-string BHA 34 above the isolation valve 88.
   c. Then attaching an upper CT section 38 to the top of the isolation valve 88.
   d. Then conducting well operations which require a relatively "full-opening" passageway through the mid-string BHA 34.
8. Method 7, steps a-c following by retrieving the lower CT section 36 from the well.

9. The method of pulling the full CT assembly (upper and lower CT sections 36, 38 and upper and lower BHA's 32, 34) until the mid-string BHA 34 is at the surface.
   a. Then closing the isolation valve 88.
   b. Then removing the mid-string BHA 34 above the isolation valve 88.
   c. Then attaching plug installation tool 92 to the mid-string BHA 34 above the isolation valve 88.
   d. Installing on or more plugs 94 in the lower CT section 36.
      i. Can be solid plugs
      ii. Can be pump-through plugs
      iii. Can be retrievable or non-retrievable
10. Method 8 followed by:
   a. Removing the entire mid-string BHA 34 leaving only the lower CT section 36 with one or more plugs 94 installed.
   b. Attaching the lower CT section 36 to an upper CT section 38.
   c. Retrieving the lower CT section 36 by spooling it on a reel 18. Step c, in which the CT section 36 passes through one or more of the following:
      i. CT lubricator 26
      ii. CT injector 22
      iii. CT gooseneck 20
11. The method of placing at least one internal plug 94 inside the lower CT section 36 before it is run into a well.
   a. Doing this with no pressure on the lower CT section 36.
   b. Doing this with pressure on the lower CT section 36.

As depicted in FIG. 12, one or more back-pressure or check valves 106 can be attached at or near an uphole end of the lower CT section 36 before the mid-string BHA 34 is attached to the lower CT section. The back-pressure valve 106 may be capable of passing through a standard, or modified, CT lubricator 26 and/or injector 22 and/or gooseneck 20. In some examples, the back-pressure valve 106 may have the same OD as the CT, allowing the CT to be retrieved with the back-pressure valve still attached.

This back-pressure valve 106 can be attached by welding, dimpling, threading or any other type of attachment method that maintains an equivalent (or close enough to equivalent) OD that allows the CT section 36 with the back-pressure valve to pass through essentially standard surface CT handling equipment without removing the back-pressure valve from the lower CT section. Any type of check valve 106 (flapper, ball check, etc.) can be used.

In some examples, any type of check valve or other type of back-pressure valve with stress reliefs or modifications made to its geometry to allow it to run through the CT injector 22 and onto the CT reel 18 without breaking or damaging the valve 106 while bending may be used. In addition, the CT injector 22 may be modified to allow a back-pressure valve 106 with an OD larger than the CT OD to pass through the injector chains in some examples. A combination of a back-pressure valve 106 and a CT connector (of any type) may be used for the same purpose.

In another example, the lower CT section 36 can be plugged by creating a frozen plug 112 in the lower CT section 36, such as, directly below the mid-string BHA 34 location. An example general method for creating a frozen plug 112 in a tubular at the surface is as follows:

1. Attach a pump-in sub (e.g., comprising an internal check valve) at an uphole end of the tubular to be plugged. (A back-pressure valve 106 or other closure device (e.g., the plug 94 with the check valve 100) may be present on the top of the tubular string that is preventing the well from flowing.) The pump-in sub allows a high-pressure pump to be attached at the uphole end of the tubular, so fluid can be pumped into the tubular from the surface.
2. Mix a suitable slurry of fluid to be frozen in place to form a plug 112. One example is a very viscous mixture of water and bentonite.
3. Using the connected pump, displace a volume of the plugging fluid from the pump, through the pump-in sub and any other components connecting the pump-in sub to the tubular.
4. Displace the plugging fluid until it is positioned inside the tubular where the plug 112 is to be formed.
5. Wrap the tubular (e.g., the lower tubing section 36) at the desired plugging location with tubing or other conduit 114 (for example, cryogenic-rated stainless steel tubing may be used).
6. Circulate liquid nitrogen or refrigerant 116 through the conduit 114 wrapped around the tubular until the fluid inside the tubular is frozen, thereby forming a plug 112.
7. Perform one or more positive pressure tests against the frozen plug 112 to ensure its pressure holding integrity.
8. Perform one or more negative pressure tests against the frozen plug 112 to ensure its pressure holding integrity.

In the context of its use with a mid-string BHA 34, a frozen plug 112 can be used to safely remove any or all components from the lower CT section 36. A frozen plug 112 is created below the mid-string BHA 34 so that all mid-string BHA components can be removed, and then appropriate equipment can be attached to the lower CT section 36, so that standard methods for removing the lower CT string from the well may be used.

Scenario/Method 1:

When the upper CT section 38 is being removed from the well, and the mid-string BHA 34 is at the surface, and it is determined that it is not possible to bleed pressure off of the entire CT string 12 including the upper and lower CT sections 36, 38 and mid-string BHA 34, this indicates that there is leak at or below the mid-string BHA (for example, a hole or leak in the lower CT section 36, or lower BHA 32). This may also indicate that one or more well control components, such as back-pressure valves 106 in or downhole of the mid-string BHA 34 are not working. This situation makes it impractical to remove the mid-string BHA 34 safely because there is pressure present.

1. Mix a suitable slurry of fluid to be frozen in place to form a plug 112. One example is a very viscous mixture of water and bentonite.
2. Using the surface pump, displace or spot a volume of the slurry from the pump through the upper CT section 38 and mid-string BHA 34 and into the lower CT section 36.
3. Displace the plugging fluid until it is positioned inside the lower CT section 36 where the plug 112 is to be formed.
4. Wrap the tubing section 36 at the desired plugging location with tubing 114 or other conduit (such as, cryogenic-rated stainless steel tubing).
5. Circulate liquid nitrogen or refrigerant 116 through the conduit wrapped around the tubing section 36 until the slurry inside the tubular is frozen, thereby forming a plug 112.
6. Using the surface pump, perform one or more positive pressure tests against the frozen plug 112 to ensure its pressure holding integrity.

7. Using the surface valving, perform one or more negative pressure tests against the frozen plug 112 by bleeding down the CT pressure at the surface to ensure its pressure holding integrity.
8. Bleed down all pressure and remove the mid-string BHA 34 from the lower CT section 36 and attach appropriate components to the top of the lower CT section to facilitate safe removal from the well.
9. Remove the lower CT section 36 from the well.

Scenario/Method 2:

When the CT string 12 is being removed from the well, and the mid-string BHA 34 is at the surface and the upper CT section 38 has been disconnected from the mid-string BHA 34, but it is determined that it is not possible to bleed pressure off of the lower CT section, this indicates that there is leak below the mid-string BHA (for example, a hole or leak in the lower CT section, or lower BHA 32). This situation makes it impractical to remove the mid-string BHA 34 safely because there is pressure present.

1. Mix a suitable slurry of fluid to be frozen in place to form a plug 112. One example is a very viscous mixture of water and bentonite.
2. Attach a pump-in sub to the uphole end of the lower CT section 36 and/or partial mid-string BHA 34.
3. Using a pump, displace a volume of the plugging fluid from the pump into the lower CT section 36.
4. Displace the plugging fluid until it is positioned inside the lower CT section 36 where the plug 112 is to be formed.
5. Wrap the tubing section 36 at the desired plugging location with tubing 114 or other conduit (such as, cryogenic-rated stainless steel tubing).
6. Circulate liquid nitrogen or refrigerant 116 through the conduit wrapped around the tubing section 36 until the fluid inside the tubular is frozen, thereby forming a plug 112.
7. Using the surface pump, perform one or more positive pressure tests against the frozen plug 112 to ensure its pressure holding integrity.
8. Using the surface valving, perform one or more negative pressure tests against the frozen plug 112 by bleeding down the CT pressure at the surface to ensure its pressure holding integrity.
9. Bleed down all pressure and remove the mid-string BHA 34 from the lower CT section 36 and attach appropriate components to the uphole end of the lower CT section to facilitate safe removal from the well.
10. Remove the lower CT section 36 from the well.

A frozen plug 112 may alternatively be used in a CT installation process for installing the mid-string BHA 34. The frozen plug 112 described above may be used as a redundant safety measure when installing or removing the mid-string BHA 34, even when no pressure or pressure problems exist (such as, when whatever valve, e.g., isolation valve 88 or back-pressure valve 106, is in place and is working as intended). Installation of the frozen plug 112 can be used as a safety step and can be a standard practice (for example, prior to cutting any coiled tubing or prior to taking tools apart) for the purpose of installation or removal of the mid-string BHA 34, even if some equipment downhole has not proven to be a problem.

In any of the situations in which a frozen plug 112 is used in a CT string 12, after the need for the frozen plug has passed the frozen plug can be allowed to melt to thereby re-open the CT string. In the above examples, a frozen plug 112 created in a lower CT section 36 downhole of a mid-string BHA 34 can be allowed to melt, thereby permitting the lower CT section to be pumped through, after any leak in the lower CT section has been mitigated, or after appropriate safety equipment has been attached.

The above disclosure provides to the art a system 10, apparatus and method, in which multiple BHA's 32, 34 are connected in a CT string 12 and deployed in a single trip into a wellbore 14. Each of the BHA's 32, 34 may comprise a vibratory tool 40.

A first one of the vibratory tools 40 may be activated after a first frac plug 44 is drilled through. A second one of the vibratory tools 40 may be activated after the first vibratory tool 40 is activated.

Each of the vibratory tools 40 may be selectively activated. The multiple BHA's 32, 34 may be deployed into the wellbore 14 prior to drilling through the first frac plug 44.

One of the BHA's 34 may be connected between two sections of coiled tubing 36, 38. The BHA 34 connected between two sections 36, 38 of coiled tubing may include a connecting tool 60 that permits relative rotation between the two sections 36, 38 of coiled tubing when sections 62, 64 of the connecting tool 60 are separated.

The connecting tool 60 may prevent relative rotation between the two sections 36, 38 of coiled tubing when the sections 62, 64 of the connecting tool are engaged. Engaging the sections 62, 64 of the connecting tool 60 may comprise engaging splines 68, 70 formed on each of the connecting tool sections.

Also provided by the above disclosure is a system 10, apparatus and method, comprising any of the following features/methods:

1. The use of a surface operable isolation valve 88 to isolate the lower CT section 36.
2. The use of a full-opening isolation valve 88 that can be closed when desired.
3. The use of the full-opening isolation valve 88 that can opened when desired.
4. The use of a full-opening isolation valve 88 that can be selectively opened or closed when desired.
5. The use of an isolation valve 88 that can be operated by pumping an activation blocking element through the valve from an uphole end of a CT string 12.
6. The use of a ball valve or flapper valve in an isolation valve 88 as described herein.
7. The method of pulling the full CT string 12 (upper and lower CT sections 36, 38 and upper and lower BHA's 32, 34) until the mid-string BHA 34 is at the surface.
   a. Then closing the isolation valve 88.
   b. Then removing the mid-string BHA 34 above the isolation valve 88.
   c. Then attaching an upper CT section 38 to the top of the isolation valve 88.
   d. Then conducting well operations which require a relatively "full-opening" passageway through the mid-string BHA 34.
8. Method 7, steps a-c followed by retrieving the lower CT section 36 from the well.
9. The method of pulling the full CT assembly (upper and lower CT sections 36, 38 and upper and lower BHA's 32, 34) until the mid-string BHA 34 is at the surface.
   a. Then closing the isolation valve 88.
   b. Then removing the mid-string BHA 34 above the isolation valve 88.
   c. Then attaching a plug installation tool 92 to the mid-string BHA 34 above the isolation valve 88.
   d. Installing one or more plugs 94 in the lower CT section 36. The plugs 94 may be solid, pump-through, retrievable and/or non-retrievable.

10. Method 8 followed by:
    a. Removing the entire mid-string BHA 34 leaving only the lower CT section 36 with one or more plugs 94 installed.
    b. Attaching the lower CT section 36 to an upper CT section 38.
    c. Retrieving the lower CT section 36 by spooling it on a reel 18. The CT string 12 may pass through one or more of the lubricator 26, the injector 22 and the gooseneck 20.
11. The method of placing at least one internal plug 94 inside the lower CT section 36 before it is run into a well. The plug 94 may be placed while there is no pressure in the lower CT section 36, or while there is pressure in the lower CT section.

In any of the above systems or methods, one or more back-pressure valves 106 may be attached to the uphole end of the lower CT section 36 before the mid-string BHA 34 is attached to the lower CT section. The back-pressure valve 106 may be capable of passing through a standard or modified, CT lubricator 26, injector 22 and/or gooseneck 20. In some examples, the back-pressure valve 106 may have the same OD as the CT, allowing the CT to be retrieved with the back-pressure valve still attached. This valve 106 can be attached by welding, dimpling, threading or any other type of attachment method that maintains an equivalent (or close enough to equivalent) OD that allows the CT to pass through essentially standard surface CT handling equipment without removing the back-pressure valve from the lower CT section 36. Any type of check valve (flapper, ball check, etc.) can be used.

In any of the above systems or methods, a check valve or other type of back-pressure valve 106 with stress reliefs or modifications made to its geometry may allow it to run through the CT injector 22 and onto the CT reel 18 without breaking or damaging the valve while bending. In addition, the CT injector 22 may be modified to allow a back-pressure valve 106 with an OD larger than the CT OD to pass through the injector chains in some examples. A combination of a back-pressure valve 106 and a CT connector (any type) may be used for the same purpose.

In any of the above systems or methods, a frozen plug 112 may be used to facilitate removal of any or all components from the lower CT section 36. A frozen plug 112 may be created below the mid-string BHA 34 so that all mid-string BHA components can be removed, and then appropriate equipment may be attached to the lower CT section 36, so that the lower CT section can be safely removed from the well. The frozen plug 112 may be allowed to melt after the appropriate equipment is attached to the lower CT section 36.

In any of the above systems or methods, a frozen plug 112 may be created in a CT string 12 during installation or removal of the CT string. The frozen plug 112 may be allowed to melt, thereby opening the CT string 12 to flow therethrough.

It may now be fully appreciated that the above disclosure provides significant advancements to the art of preforming well operations with multiple bottom hole assemblies. In examples described above, the multiple tubing sections 36, 38 can be safely retrieved from the wellbore 14, even if there is elevated in the first tubing section 36 connected between bottom hole assemblies 32, 34.

The above disclosure provides to the art a system 10 for use with a subterranean well. In one example, the system 10 can comprise: a first bottom hole assembly 32 connected at a distal end of a first tubing section 36, and a second bottom hole assembly 34 connected between the first tubing section 36 and a second tubing section 38. The second tubing section 38 comprises continuous coiled tubing 16. The coiled tubing 16 may extend from the second bottom hole assembly 34 to a surface location.

Each of the first and second bottom hole assemblies 32, 34 may comprise a vibratory tool 40. The first bottom hole assembly 32 may further comprise a fluid motor 46.

The second bottom hole assembly 34 may comprise a connecting tool 60 configured to connect first and second sections of the second bottom hole assembly 34 without rotation of the first and second tubing sections 36, 38. The connecting tool 60 may comprise internal and external splines 68, 70, and engagement between the splines 68, 70 may prevent relative rotation between the first and second sections of the second bottom hole assembly 34.

The second bottom hole assembly 34 may comprise a valve 88 that selectively permits and prevents fluid flow axially through the second bottom hole assembly 34. The valve 88 may be operable from an exterior of the valve 88.

The system 10 may comprise a valve 106 connected in the first tubing section 36. The valve 106 may be configured to be spoilable on a reel 18 with the first tubing section 36.

A method of performing a well operation is also provided to the art by the above disclosure. In one example, the method can comprise: deploying a tubular string 12 into a wellbore 14, the tubular string 12 comprising first and second tubing sections 36, 38, a first bottom hole assembly 32 connected at a distal end of the first tubing section 36, and a second bottom hole assembly 34 connected between the first and second tubing sections 36, 38. The second tubing section 38 comprises continuous coiled tubing 16. The tubular string 12 is retrieved from the wellbore 14. The deploying and the retrieving are performed in a single trip of the tubular string 12 into the wellbore 14.

The method may include placing a plug 94, 112 in the first tubing section 36. The placing may comprise freezing the plug 112 in the first tubing section 36. The placing may be performed during the retrieving.

The plug 94 may comprise a check valve 100 that permits fluid flow in a first axial direction, and prevents fluid flow in an opposite second axial direction, through the check valve 100.

The deploying step may include connecting first and second sections of the second bottom hole assembly 34 while the first and second sections of the second bottom hole assembly 34 are connected to the respective first and second tubing sections 36, 38. The connecting step may include engaging splines 68, 70 of the first and second sections of the second bottom hole assembly 34, thereby preventing relative rotation between the first and second sections of the second bottom hole assembly 34.

The deploying step may include connecting a valve 88 in the second bottom hole assembly 34, the valve 88 selectively permitting and preventing fluid flow axially through the second bottom hole assembly 34. The retrieving step may include closing the valve 88 when the valve is at a surface location.

The closing step may be performed from an exterior of the valve 88. The method may include placing a plug 94 in the first tubing section 36, the placing comprising displacing the plug 94 through the valve 88.

The deploying step may include connecting a valve 106 in the first tubing section 36. The retrieving step may include spooling the valve 106 on a reel 18 with the first tubing section 36. The valve 106 may comprise a check valve that permits fluid flow in a first axial direction, and prevents fluid flow in an opposite second axial direction, through the first tubing section 36.

The deploying step may include connecting a first vibratory tool 40 in the first bottom hole assembly 32, and connecting a second vibratory tool 40 in the second bottom hole assembly 34. The deploying step may include connecting a fluid motor 46 in the first bottom hole assembly 32.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a first bottom hole assembly connected at a distal end of a first tubing section; and a second bottom hole assembly connected between the first tubing section and a second tubing section, in which the second tubing section comprises continuous coiled tubing, in which the second bottom hole assembly comprises a connecting tool configured to connect first and second sections of the second bottom hole assembly while the first and second sections of the second bottom hole assembly are connected to the respective first and second tubing sections.

2. The system of claim 1, in which the coiled tubing extends from the second bottom hole assembly to a surface location.

3. The system of claim 1, in which each of the first and second bottom hole assemblies comprises a vibratory tool.

4. The system of claim 3, in which the first bottom hole assembly further comprises a fluid motor.

5. The system of claim 1, in which the connecting tool comprises internal and external splines, and engagement between the splines prevents relative rotation between the first and second sections of the second bottom hole assembly.

6. The system of claim 1, in which the second bottom hole assembly comprises a valve that selectively permits and prevents fluid flow axially through the second bottom hole assembly.

7. The system of claim 6, in which the valve is operable from an exterior of the valve.

8. The system of claim 1, further comprising a valve connected in the first tubing section.

9. The system of claim 8, in which the valve is configured to be spoolable on a reel with the first tubing section.

10. A method of performing a well operation, the method comprising:

deploying a tubular string into a wellbore, the tubular string comprising first and second tubing sections, a first bottom hole assembly connected at a distal end of the first tubing section, and a second bottom hole assembly connected between the first and second tubing sections, in which the second tubing section comprises continuous coiled tubing, and in which the deploying comprises connecting first and second sections of the second bottom hole assembly while the first and second sections of the second bottom hole assembly are connected to the respective first and second tubing sections; and retrieving the tubular string from the wellbore, in which the deploying and the retrieving are performed in a single trip of the tubular string into the wellbore.

11. The method of claim 10, further comprising placing a plug in the first tubing section.

12. The method of claim 11, in which the placing comprises freezing the plug in the first tubing section.

13. The method of claim 11, in which the placing is performed during the retrieving.

14. The method of claim 11, in which the plug comprises a check valve that permits fluid flow in a first axial direction, and prevents fluid flow in an opposite second axial direction, through the check valve.

15. The method of claim 10, in which the connecting comprises engaging splines of the first and second sections of the second bottom hole assembly, thereby preventing relative rotation between the first and second sections of the second bottom hole assembly.

16. The method of claim 10, in which the deploying comprises connecting a valve in the second bottom hole assembly, the valve selectively permitting and preventing fluid flow axially through the second bottom hole assembly.

17. The method of claim 16, in which the retrieving comprises closing the valve when the valve is at a surface location.

18. The method of claim 17, in which the closing is performed from an exterior of the valve.

19. The method of claim 16, further comprising placing a plug in the first tubing section, the placing comprising displacing the plug through the valve.

20. The method of claim 10, in which the deploying further comprises connecting a valve in the first tubing section, and in which the retrieving comprises spooling the valve on a reel with the first tubing section.

21. The method of claim 20, in which the valve comprises a check valve that permits fluid flow in a first axial direction, and prevents fluid flow in an opposite second axial direction, through the first tubing section.

22. The method of claim 10, in which the deploying comprises connecting a first vibratory tool in the first bottom hole assembly, and connecting a second vibratory tool in the second bottom hole assembly.

23. The method of claim 10, in which the deploying comprises connecting a fluid motor in the first bottom hole assembly.

* * * * *